US005611610A

United States Patent [19]

Katz et al.

[11] Patent Number: 5,611,610

[45] Date of Patent: Mar. 18, 1997

[54] CONTROL HOUSING

[75] Inventors: Jonathan M. Katz; Scott A. Calvert; Kevin S. Laundroche, all of Louisville, Ky.

[73] Assignee: General Electric Company, Louisville, Ky.

[21] Appl. No.: 416,174

[22] Filed: Apr. 4, 1995

[51] Int. Cl.[6] ..... A47B 47/00

[52] U.S. Cl. ..... 312/263; 312/265.5; 312/265.6; 312/293.1

[58] Field of Search ..... 312/293.3, 293.2, 312/293.1, 140.4, 279, 248, 263, 265.5, 265.6, 257.1, 223.1, 228; 220/4.02

[56] References Cited

U.S. PATENT DOCUMENTS

| | | | |
|---|---|---|---|
| 3,173,730 | 3/1965 | Collins | 312/279 X |
| 3,253,874 | 5/1966 | Czech | 312/257 |
| 4,288,133 | 9/1981 | Deatherage | 312/279 |
| 4,507,942 | 4/1985 | Hirose et al. | 312/223.1 X |
| 4,765,698 | 8/1988 | Dooley | 312/265.5 X |
| 4,798,424 | 1/1989 | Coates et al. | 312/257 R |
| 5,350,140 | 9/1994 | Ripley et al. | 312/257.1 X |
| 5,375,921 | 12/1994 | Tupa et al. | 312/279 X |

FOREIGN PATENT DOCUMENTS

| | | | |
|---|---|---|---|
| 22948 | 3/1978 | Japan | 312/265.6 |

*Primary Examiner*—Peter M. Cuomo
*Assistant Examiner*—Janet M. Wilkens
*Attorney, Agent, or Firm*—H. Neil Houser

[57] ABSTRACT

A control housing for an appliance includes a rear wall and a pair of end caps extending forward from the ends of the rear wall. A control panel assembly extends between the end caps forward of the rear wall. The panel assembly includes a cover plate with a planar body having a perpendicularly projecting rim extending along its top, bottom and ends. The assembly also includes a control mounting plate with a planar body. The mounting plate is shorter than the cover member. The plates are assembled in overlying relationship with the mounting plate positioned within the cover plate rim. A pair of bridging members are connected to the ends of the mounting plate and fit closely within the end portions of the cover plate.

15 Claims, 3 Drawing Sheets

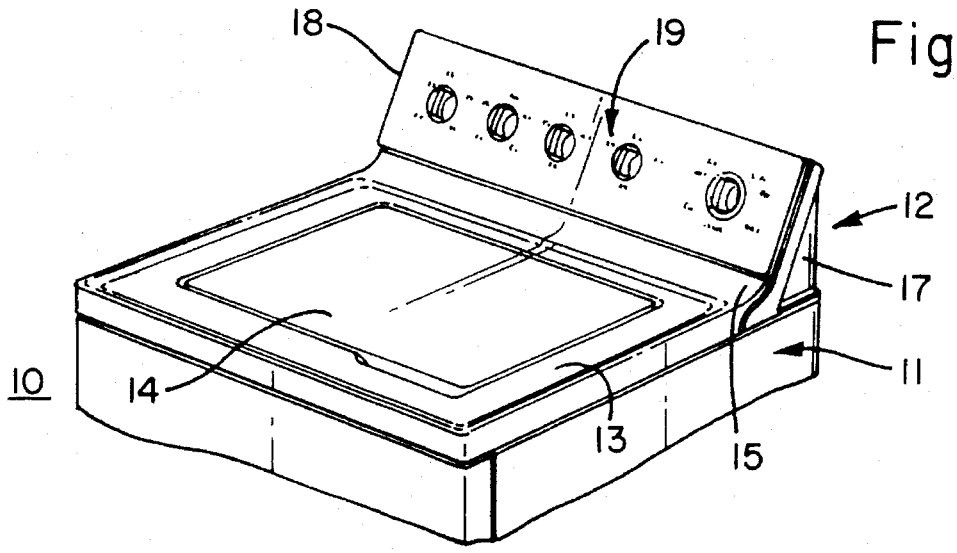
Fig. 1
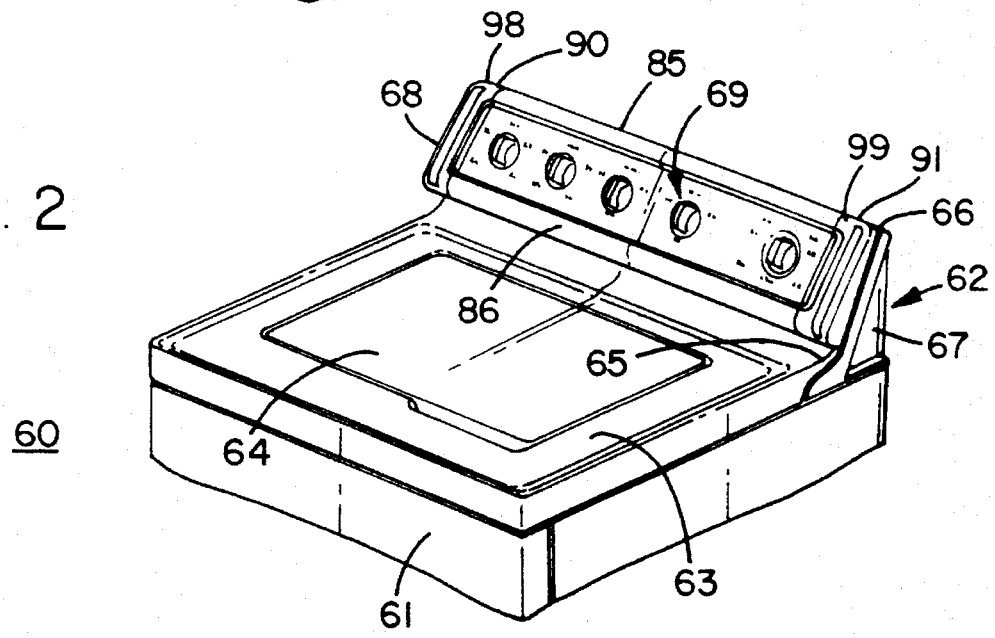
Fig. 2
Fig. 3
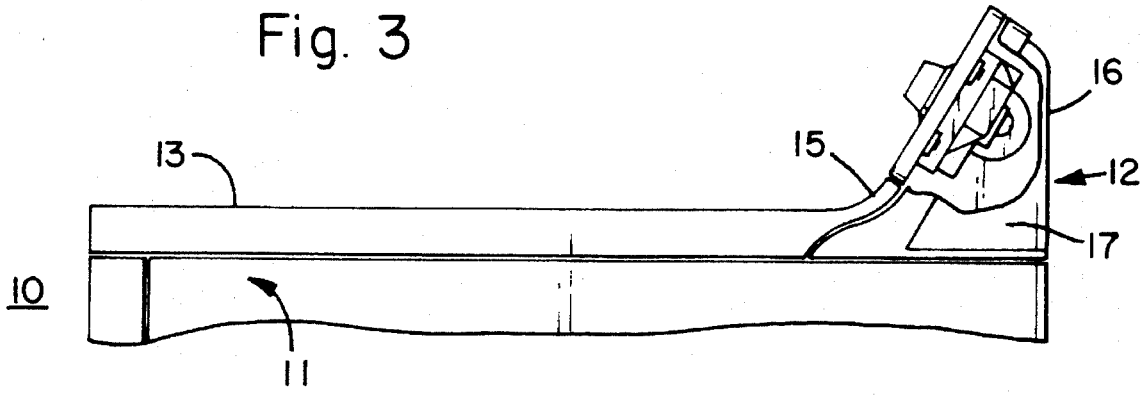

CONTROL HOUSING

BACKGROUND OF THE INVENTION

This invention relates to appliances, and more particularly, to improved control housings for such appliances.

Various manufacturers of large household appliances make a number of models of each type of appliance and often sell appliances under more than one brand. In addition manufacturers often make appliances for other manufacturers and national retailers to sell under their brands. Often different brands or different models of such appliances are mechanically the same or very similar. It is important to manufacturers, for a number of reasons, to have brand differentiation; that is for appliances of different brands to be visually different; even though they are manufactured by the same manufacturer and are mechanically very similar or even the same.

The control area provides an opportunity for manufacturers to obtain such brand differentiation. Clothes washers and dryers and ranges generally have a free standing control housing along their upper rear edge. This provides a convenient area in which to obtain a degree of visual brand differentiation. Of course it is possible for a manufacturer to provide each brand with an entirely different control housing. However, this unduly increases the number of parts and complicates the manufacturing process, all adding to the cost of the appliances.

SUMMARY OF THE INVENTION

It is an object of this invention to provide an improved control housing for appliances.

It is another object of this invention to provide such an improved housing that can be modified to present significantly different appearances with a minimum number of separate parts.

In accordance with one aspect of the invention the ends of the control mounting plate and the adjacent cover plate are joined by bridging members selected from a number of such members having different shapes so that the overall appearance of the control housing between different machines can be made visually different.

In one embodiment of the invention the control housing includes a rear wall and end caps extending forward of each end of the rear wall. A control panel assembly extends between the end caps forward of the rear wall. The assembly includes a generally rectangular cover plate having spaced apart ends and a generally rectangular control mounting plate having spaced apart ends. The cover and mounting plates are assembled in juxtaposed overlying relationship. The assembly also includes a pair of bridging members mounted to the mounting plate and bridging between and engaging the ends of the cover and mounting plates. The bridging members and the plates have predetermined shapes selected from a number of predetermined shapes to provide the control housing with a distinctive visual appearance.

BRIEF DESCRIPTION OF THE DRAWINGS

FIG. 1 is a fragmentary front perspective view of an automatic clothes washing machine incorporating one form of the present invention and utilizing bridging members of one predetermined shape.

FIG. 2 is a fragmentary front perspective view of an automatic clothes washing machine utilizing bridging members of another predetermined shape.

FIG. 3 is a fragmentary side view of the machine of FIG. 1, with a portion of the control housing broken away.

DETAILED DESCRIPTION OF PREFERRED EMBODIMENT

Figure 4:
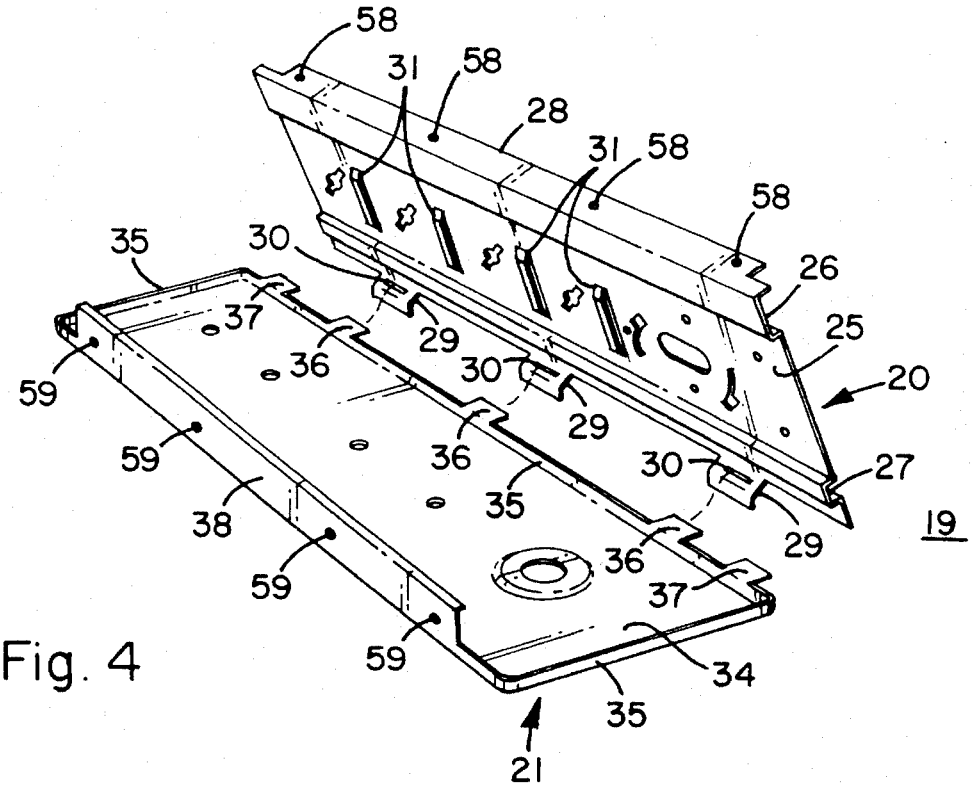
FIG. 4 is an exploded view of the cover plate and the control mounting plate of the control housing of FIG. 1.

Referring to FIGS. 1 and 3, there is shown an automatic clothes washing machine 10 incorporating one embodiment of the present invention. The washing machine includes a cabinet 11 and a control housing 12, often referred to as a backsplash. The cabinet 11 includes a top member 13 which has a lid 14 to provide access to the interior of the machine. The top member 13 extends completely from side to side of the housing while its rear portion 15 stops forward of the rear of the machine and is upturned. The control housing includes an elongated rear wall 16 (FIG. 3) with its ends joined to a pair of end caps 17,18. The rear wall and end cap assembly is mounted to the housing 11 behind the rear portion 15 of the top member 13 and the end caps extend forward from the rear wall 16 and engage the top member rear portion 15. Additional details of the mounting of the rear wall and end cap assembly to the housing can be obtained by reference to co-pending application Ser. No. 08/416,057, of Jon Katz et al, entitled Appliance Top Assembly, and assigned to General Electric Company, assignee of the present invention, which application is incorporated herein by reference. The control housing 12 also includes a control panel assembly 19 which is pivotally movable between a closed position, against the rear wall 16 and end caps 17,18, as shown in FIGS. 1 and 3, and an open position exposing the inside of housing 12.

Figure 5:
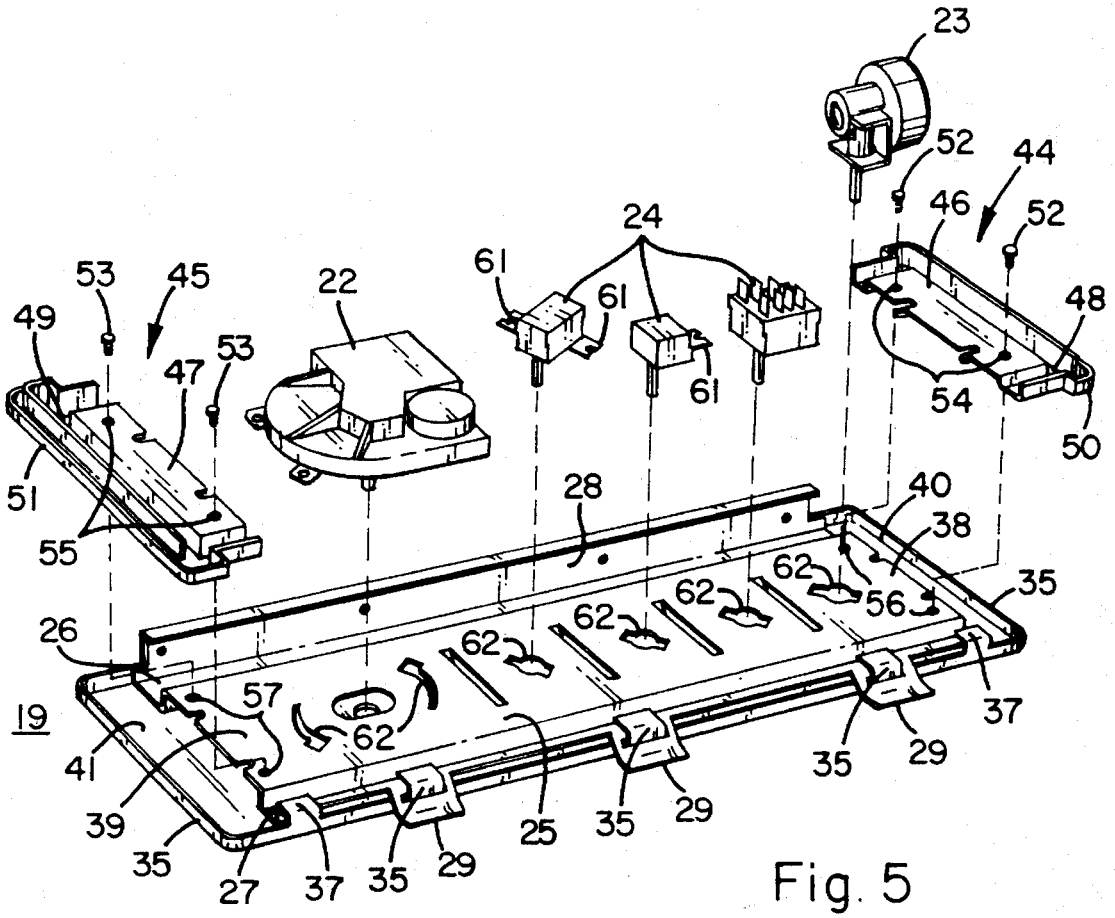
FIG. 5 is an exploded view of the control panel assembly of FIG. 1, including the bridging members and various controls.

Referring now to FIGS. 4 and 5, the control panel assembly includes a control mounting plate 20 and a cover plate 21. The elongated mounting plate 20 preferably is formed from a relatively heavy metal, such as sheet steel for example, and supports various controls such as timer 22, water level control 23 and rotary switches 24. It will be understood that other washers and other appliances may have different numbers of similar or different controls. The function and internal construction of the controls do not form a part of this invention and the particular controls are shown for illustrative purposes.

The mounting plate 20 includes a generally rectangular, planar body 25 with an elongated rib 26 adjacent its top edge and an elongated rib 27 along its bottom edge. The ribs 26,27 project forward of the body 25, that is toward cover plate 21. A flange 28 projects rearward along the top edge and a plurality of spaced apart tabs 29 project from the bottom edge. A transverse slot 30 extends across each tab 29. Vertically extending transverse tabs 31 are lanced from plate 20 at locations spaced apart along body 25 and form standoffs between plates 20 and 21.

The cover plate 21 conveniently is formed from a thin sheet of a suitable metal, such as aluminum, and normally has graphic elements on its face, including indicia associated with the controls 22–24. The cover plate 21 is in the form of a generally rectangular, planar body 34 with a top, a bottom and spaced apart ends. A rearwardly projecting rim 35 is formed integrally with and extends along the top, bottom and ends of the body 34. The corners of the body 34 are curved as is the intersection of the body and rim so the cover plate can be drawn from a single sheet of material without rupturing. A plurality of spaced apart tabs 36 depend from the rim 35 along the bottom of the plate 21 and correspond to the slots 30 in tabs 29 of plate 20. If desired, additional tabs 37 also depend from the rim 35. Along the top of the cover plate 21, the rim 35 extends into a rearwardly projecting flange 38.

The plates 20,21 are assembled in overlying juxtaposition by inserting the tabs 36 through the slots 30 in tabs 29 and rotating the members 20,21 together so that the ribs 26,27 at the top and bottom of mounting plate 20 fit against the top and bottom of rim 35 on cover plate 21. The tabs 36 then are bent over to secure the plates 20,21 together. Also, if present, additional tabs 37 also are bent over. The ribs 26,27 and the transverse tabs or standoffs 31 bear against the planar body 34 of the cover plate and provide additional strength and rigidity. If desired, the ribs 26,27 and tabs 31 can be attached to the cover 21 by some suitable means, such as double backed foam tape or other adhesive.

It will be noted from FIG. 5, that the mounting plate 20 is shorter than cover plate 21 and the ends 38,39 of the plate 20 are spaced longitudinally inward of the ends 40, 41 of the cover 21. Bridging members 44,45 connect the ends 38,39 with the ends 40,41. That is each bridging member bridges or spans the gap between the plates 20,21 and engages a corresponding pair of ends 38,40 and 39,41 respectively. The bridging members preferably are molded of a suitable plastic material, such as PVC for example. The member 44 includes a central web 46 surrounded by a generally U-shaped rib 48 and a perpendicular outer wall 50. The member 44 is mounted to the mounting plate 20 with the web 46 overlying mounting plate end portion 38. The rib 48 is sized so that its bottom will rest against the body 34 of plate 21. The bridging member is mounted to plate 20 by screws 52 which pass through openings 54 in web 46 and are threadedly received in openings 56 in body 25 of mounting plate 20. The openings 54 are slightly elongated longitudinally of the plate 20 so that the position of the member 44 can be adjusted to assure that the peripheral wall 50 engages the end portion of rim 35 around the plate 21.

Similarly, member 45 includes a central web 47 surrounded by a generally U-shaped rib 49 and a perpendicular outer wall 51. The member 47 is mounted to the mounting plate 20 with the web 49 overlying mounting plate end portion 39. The rib 49 is sized so that its bottom will rest against the body of plate 21. The bridging member 45 is mounted to plate 20 by screws 53 which pass through openings 55 in web 47 and are threadedly received in openings 57 in body 25. The openings 55 are slightly elongated longitudinally of the plate 20 so that the position of the member 45 can be adjusted to assure that the peripheral wall 51 engages the end portion of rim 35 around the plate 21.

The ribs 48,49 in the bridging members 44,45 are aligned with the ribs 26,27 at the top and bottom of plate 20 and form a continuous rib structure around plate 20 that engages the body 34 and rim 35 of plate 21. This provides stability and strength to the control panel assembly 19.

The cover panel assembly 19 is mounted on the machine 10 by inserting the tabs 29 into slots (not shown) in the upper edge of housing top wall rear portion 15 and pivoting the assembly 19 rearward into engagement with rear wall 16 and end caps 17,18. With the assembly 19, the end portions of the cover plate 21 engage the end caps 17,18 and the flanges 28,38 overlie the top of rear wall 16. The panel assembly is connected to the rear wall and end caps by screws (not shown) that pass through aligned openings 58,59 in the flanges and are threadedly received in the rear wall and end caps.

The controls 22–24 are mounted to plate 20. One suitable control mounting arrangement includes ears on each control, such as those shown at 61, which are inserted into mating slots 62 in the plate 20. Additional details of such an arrangement can be obtained by reference to co-pending application Ser. No. 08/416,059, of Jon Katz, entitled Appliance Control Mounting and assigned to General Electric Company, the assignee of this invention; which application is incorporated herein by reference.

Referring now to FIG. 2, there is shown a clothes washing machine 60 incorporating a control panel assembly with different shaped bridging members. The washing machine 60 includes a cabinet 61 and a control housing 62. The cabinet has a top member 63 with an access lid 64. The rear portion 65 of the top 63 is upturned. The control housing includes rear wall 66 attached to end caps 67,68, which extend forward from the rear wall. The machine as thus far described conveniently can be the same as that of FIG. 1, 3–5.

Figure 6:
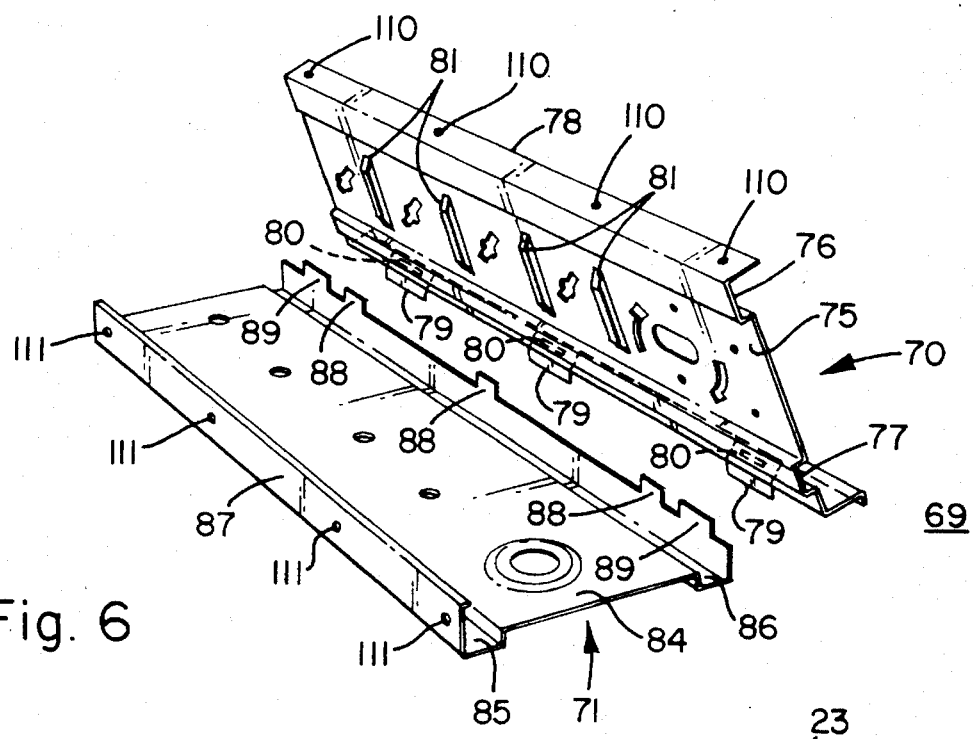
FIG. 6 is an exploded view of the cover plate and the control mounting plate of the control housing of FIG. 2.
Figure 7:
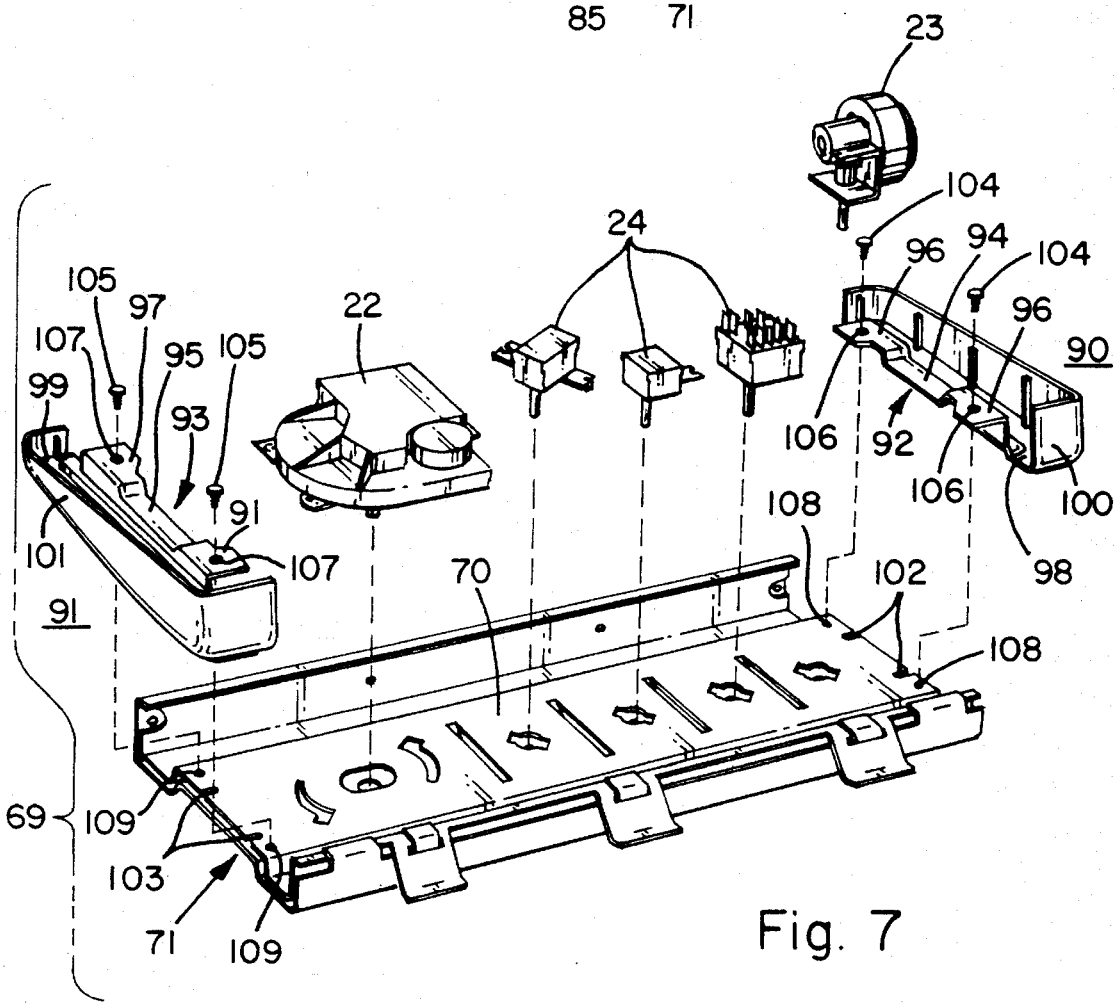
FIG. 7 is an exploded view of the control panel assembly of FIG. 2, including the bridging members and various controls.

Referring now to FIGS. 6 and 7, the control housing 62 includes a control panel assembly 69, with a control mounting plate 70 and a cover plate 71. The elongated mounting plate 70 may be formed of sheet steel and supports various controls such as timer 22, water level control 23 and rotary switches 24. Conveniently the controls are mounted on plate 70 by some suitable means, such as that previously described for example.

Conveniently the plate 70 may be the same as plate 20, with a generally rectangular, planar body 75 having a rib 76 along its top and a rib 77 along its bottom. The ribs project toward the cover plate 71. A flange 78 projects rearward from the distal edge of top rib 76 and a plurality of spaced apart tabs 79 project from the distal edge of bottom rib 77. A slot 80 is formed in each tab 79. Vertically extending transverse tabs 81 are lanced from body 25 and form standoffs between plates 70,71.

The cover plate 71 is formed from a thin sheet of material such as aluminum and has graphic elements on its front. The plate 71 is slightly different in shape than the plate 21 to accommodate differently shaped bridging members, as will be explained in more detail hereafter. The plate 71 is in the shape of an elongated rectangle with a planar body 84 having a top, a bottom and ends. Forwardly projecting ribs 85,86 extend along the top and bottom respectively of the body. A flange 87 projects rearward along the distal edge of rib 85 while tabs 88 project from the distal edge of rib 86. The tabs 88 are spaced apart and coincide with slots 80 in tabs 79. Additional tabs 89 also project from the edge of rib 86.

The plates 70,71 are assembled in overlying juxtaposition by inserting tabs 88 through slots 80 in tabs 79 and rotating the plates together. The tabs 88 and additional tabs 89 then are bent over to secure the plates in their assembled configuration. As can be seen from FIG. 7, the ribs 76,77 of plate 70 fit closely within the ribs 85,86 of the plate 71. The standoffs 81 engage the plate 71 and conveniently are attached thereto by double back foam tape or other suitable adhesive.

Plates 70,71 are substantially the same length so that their ends are adjacent. Bridging members 90,91 connect the ends of the plate 70,71; that is they span the gap between the plates and engage the ends of the plates. Additionally they provide the ends for the panel assembly 69. The bridging members preferably are molded from a suitable plastic material, such as PVC for example. Bridging member 90 has a web 92 with a lowered central section 94 flanked by raised feet 96. The web is surrounded by a U-shaped rib 98 and a perpendicular outer wall 100. The member 90 is mounted on the plate 70 by interlacing the web 92 with a pair of slots 102 in the end of plate 70, with the central section 94 under plate 70 and the feet 96 over plate 70 (as viewed in FIG. 7). The member 90 then is attached to plate 70 by screws 104 which pass through openings 106 in web 92 and are threadedly received in openings 108 in plate 70. The member 90 is sized so that the rib 98 and outer wall 100 mesh with the ribs 85,86 along the top and bottom of cover plate 71.

Similarly bridging member 91 has a web 93 with a lowered central section 95 flanked by raised feet 97. The web is surrounded by an U-shaped rib 99 and a perpendicular outer wall 101. The member 91 is mounted on the plate 70 by interlacing the web 93 with a pair of slots 103 in the end of plate 70, with the central section 95 under plate 70 and the feet 97 over plate 70 (as viewed in FIG. 7). The member 91 then is attached to plate 70 by screws 105 which pass through openings 107 in web 92 and are threadedly received in openings 109 in plate 70. The member 91 is sized so that the rib 99 and outer wall 101 mesh with the ribs 85,86 along the top and bottom of cover plate 71.

The control panel assembly 69 is mounted on the machine 60 by inserting the tabs 79 into slots (not shown) in the rear upturned rear portion 65 of machine top 63 and rotating the assembly 69 into engagement with rear wall 66 and end caps 67,68. The assembly is attached to the rear wall and end caps by screws (not shown) which pass through openings 110 in plate 70 and 111 in plate 71 and are received in the rear wall and end caps.

It will be seen from FIG. 2 that the bridging members 90,91 form the ends of the panel assembly 69 and engage the front of the end caps 67,68. It also can be seen that the ribs 85,86 in cover plate 71, together with ribs 98,99 in the bridging members 90,91 form a continuous raised ledge around the front of the cover plate 71. In addition, the outer walls 100,101 are wider at the bottom of the control housing than at the top, which extends the bottom front of the control housing forward. All of this provides the control housing of FIG. 2 with a significantly different appearance than the control housing of FIG. 1. At the same time the only components which are different are the plastic bridging members and the relatively inexpensive aluminum cover sheet.

While specific embodiments of the invention have been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. A control housing including:

a rear wall having spaced apart ends and a pair of end caps engaging said ends of said rear wall and extending forward thereof;

a control panel assembly extending between said end caps forward of said rear wall; said panel assembly including a cover plate having an elongated, generally rectangular planar body with spaced apart ends and a control mounting plate having an elongated, generally rectangular planar body with spaced apart ends; said cover plate and said mounting plate being assembled in a juxtaposed overlying relationship; and said control panel assembly also including a pair of bridging members, each of said bridging members having a central web overlying and mounted to said control mounting plate planar body and bridging between and engaging corresponding ends of said cover plate and said mounting plate;

each of said bridging members having a shape selected from a number of predetermined different shapes adapted to provide said control housing with a distinctive visual appearance.

2. A control housing as set forth in claim 1, wherein: said bridging members are formed of molded plastic.

3. A control housing as set forth in claim 1, wherein:

said cover plate includes top and bottom edges; a flange projects perpendicularly along said cover plate top edge and a plurality of spaced apart tabs project from said cover plate bottom edge; and said mounting plate includes top and bottom edges; a flange projects perpendicularly along said mounting plate top edge and a plurality of spaced apart tabs project from said mounting plate bottom edge; each of said mounting plate tabs including a slot;

said cover plate and mounting plate being assembled with said mounting plate flange positioned against said cover plate flange and with said cover plate tabs received through said mounting plate tab slots and bent over to secure said cover plate and said mounting plate together.

4. A control housing as set forth in claim 3, further including: a plurality of standoffs lanced out of said mounting plate and positioned against said cover plate.

5. A control housing including:

a rear wall having spaced apart ends and a pair of end caps engaging the ends of said rear wall and extending forward thereof;

a control panel assembly extending between said end caps forward of said rear wall; said panel assembly including an elongated, generally rectangular cover plate having a generally planar body with a top, a bottom and ends and with a perpendicularly projecting rim extending along its top, bottom and ends, said body and rim being rounded at the corners of said body;

said panel assembly also including an elongated, generally rectangular control mounting plate having a generally planar body with a top, a bottom and ends, said mounting plate being shorter end to end than said cover plate;

said cover plate and said mounting plate being assembled in a juxtaposed overlying relationship with said mounting plate received within said cover plate rim and with each end of said mounting plate spaced inward of the corresponding end of said cover plate; and said control panel assembly also including a pair of bridging members, said bridging members being mounted to said control mounting plate adjacent said ends thereof and fitting closely within said cover plate rim adjacent the corresponding ends of said cover plate.

6. A control housing as set forth in claim 5, wherein: said bridging members are formed of molded plastic.

7. A control housing as set forth in claim 5, wherein:

elongated ribs extend along said top and bottom of said mounting plate body, said ribs being offset from said mounting plate body toward said cover plate;

said bridging members being aligned with said ribs to form a rim extending around said mounting plate, said mounting plate rim engaging said cover plate body and fitting closely within said cover plate rim.

8. A control housing as set forth in claim 7, wherein:

a plurality of spaced apart tabs project from said bottom of said cover plate; and a plurality of tabs project from said bottom of said mounting plate, each of said mounting plate tabs having a slot therein;

said cover plate tabs being received through said mounting plate tab slots and bent over to secure said plates together.

9. A control housing as set forth in claim 7, further including: a plurality of standoffs lanced out of said mounting plate body and positioned against said cover plate body.

10. A control housing including:

a rear wall having spaced apart ends and a pair of end caps engaging said ends of said rear wall and extending forward thereof;

a control panel assembly extending between said end caps forward of said rear wall; said panel assembly including an elongated, generally rectangular cover plate having a generally planar body with a top, a bottom and ends and with a rim along its top and bottom;

said panel assembly also including an elongated, generally rectangular control mounting plate having a planar body with a top, a bottom and ends and with a rim along its top and bottom, said mounting plate being sized to fit within said cover plate;

said cover plate and said mounting plate being assembled in a juxtaposed overlying relationship and with said mounting plate rims positioned between said cover plate rims and with each of said of said mounting plate ends positioned adjacent a corresponding end of said cover plate; and said control panel assembly also including a pair of bridging members, each of said bridging members having a central web mounted to said control mounting plate planar body adjacent a corresponding end thereof and bridging between said cover plate and said mounting plate, said bridging members forming ends of said control panel assembly and engaging said end caps.

11. A control housing as set forth in claim 10, wherein: said bridging members are formed of molded plastic.

12. A control housing as set forth in claim 10, wherein:

said cover plate includes forwardly projecting ribs extending along its top and bottom inside its rims; and said bridging members include ribs mating with said cover plate ribs to provide an essentially continuous rib structure along the top bottom and ends of said control panel assembly.

13. A control housing as set forth in claim 12, wherein: said mounting plate includes forwardly projecting ribs extending along its top and bottom inside its rims; said mounting plate ribs being received within said cover plate ribs.

14. A control housing as set forth in claim 13, further including: a plurality of standoffs lanced out of said mounting plate and positioned against said cover plate.

15. A control housing as set forth in claim 10, wherein:

a plurality of spaced apart tabs project from said rim along the bottom of said cover plate;

a plurality of tabs project from said rim along said bottom of said mounting plate, each of said mounting plate tabs having a slot therein;

said cover plate tabs being received through said mounting plate tab slots and bent over to secure the plates together.

* * * * *